US006225950B1

(12) United States Patent
Johansson et al.

(10) Patent No.: US 6,225,950 B1
(45) Date of Patent: May 1, 2001

(54) POLARIZATION ISOLATION IN ANTENNAS

(75) Inventors: Ingrid Camilla Johansson, Kareby; Christer Bruno Lindqvist, Lindome; Jonas Sven James Sandstedt, Göteborg; Bengt Inge Svensson, Mölndal; Björn Gunnar Johannisson, Kungsbacka, all of (SE)

(73) Assignee: Telefonaktiebolaget L M Ericsson (publ) (SE)

( * ) Notice: Subject to any disclaimer, the term of this patent is extended or adjusted under 35 U.S.C. 154(b) by 0 days.

(21) Appl. No.: 09/441,986

(22) Filed: Nov. 17, 1999

(30) Foreign Application Priority Data

Nov. 20, 1998 (SE) ..... 9803985

(51) Int. Cl.[7] ..... H01Q 1/38

(52) U.S. Cl. ..... 343/700 MS; 343/829; 343/846

(58) Field of Search ..... 343/700 MS, 824, 343/826, 827, 846, 848, 829; H01Q 1/38

(56) References Cited

U.S. PATENT DOCUMENTS

| | | | | |
|---|---|---|---|---|
| 4,857,938 | * | 8/1989 | Tsukamoto et al. | 343/700 MS |
| 5,896,107 | * | 4/1999 | Huynh | 343/700 MS |
| 5,923,296 | * | 7/1999 | Sanzgiri et al. | 343/700 MS |
| 5,945,951 | * | 8/1999 | Monte et al. | 343/700 MS |
| 5,949,376 | * | 9/1999 | McDonald et al. | 343/700 MS |
| 6,104,347 | * | 8/2000 | Snygg et al. | 343/700 MS |

FOREIGN PATENT DOCUMENTS

| | | |
|---|---|---|
| 0360692 A1 | 3/1990 | (EP) . |
| 0447218 A2 | 9/1991 | (EP) . |
| 1572 273 | 7/1980 | (GB) . |
| WO 89/08933 | 9/1989 | (WO) . |

OTHER PUBLICATIONS

Bengtsson, R.; International–Type Search Report, Sep. 1, 1999; Search Request No. SE98/01296; p. 1–4.

* cited by examiner

*Primary Examiner*—Don Wong
*Assistant Examiner*—Hoang Nguyen
(74) *Attorney, Agent, or Firm*—Jenkens & Gilchrist

(57) ABSTRACT

An antenna presenting improved polarization isolation is disclosed which presents at least two columns of rectangular micro-strip or patch elements which each has a single, linear polarization. Each column presents radiation elements of either about +45 or −45 degrees. At least two such columns are combined such that an antenna is obtained which then becomes dual polarized. Furthermore the columns are arranged such that the patches are alternately sidewise displaced to form a herringbone pattern. In other words a next patch of one column is placed on the symmetry lines through nearby patches of the other column. In this way the coupling between the patches is minimized and a high isolation is achieved between the two states of polarization. The achieved two linear states of polarization are utilized separately for polarization diversity. Furthermore in the preferred embodiment the structure of the antenna is designed to compensate for pointing errors between the columns due to unsymmetrical ground-planes.

9 Claims, 4 Drawing Sheets

STATE OF THE ART

POLARIZATION ISOLATION IN ANTENNAS

TECHNICAL FIELD

The present invention relates to polarization isolation and more particularly to a method and an arrangement for further increasing the isolation between antennas having two separate states of polarization in a microwave antenna.

BACKGROUND

In modern communication systems, for instance for base stations serving cellular mobile telephones, antennas of different states of polarization are utilized. Traditionally vertical polarization is used for both the transmitter and receiver and utilization of dual antennas with a separation distance for obtaining diversity reception. It was also found that a diversity gain was obtained when using two differently polarized antennas together at the same location, typically a horizontal and a vertical polarization, respectively. It has also been found favorable to utilize receive antennas having ±45° polarization provided that a good isolation is maintained between them.

In this context there are found several documents involving at least two states of polarization. Several documents are also found which address sequentially rotated elements and the way such actions improve various antenna characteristics.

One document WO 89/08933 and also another document GB, A, 1 572 273 disclose a pair of mutually similar antennas. A number of rectangular portions of microstrip conductors are either directly electrically connected to (WO 89/08933) or electromagnetically connected to (GB, A, 1 572 273) two groups of parallel feed conductors. The small radiators are not placed parallel to the feed but form an angle to a vertical line. By connecting the feeders together with a suitable mutual phase difference dual circular states of polarization are obtained. However, the isolation between the connection ports is not discussed, but the isolation between the elements is apparently to be maintained by the distance between those. Furthermore nothing is mentioned about any particular positioning of the elements.

For antennas polarized for instance ±45° it may be an advantage to utilize single polarized elements. Feeding of single polarized radiation elements is easier to arrange with good matching than with dual polarized elements. To be able to handle both the states of polarization in one column the elements then must be closely placed. If according to the state of the art an antenna column is designed having every second element polarized at +45° and every other element polarized at −45° according to FIG. 1 there will be a problem to achieve an isolation of more than 20 dB.

Therefore there is still a desire to find an antenna design, which presents a better isolation than what is achieved in arrays according to the state of the art.

SUMMARY

An antenna according to the present invention is characterized in that it has at least two columns of rectangular micro-strip or patch elements which each has a single, linear polarization. Each column presents radiation elements of either +45° or −45° degrees. At least two such columns are combined such that an antenna is obtained which then becomes dual polarized. Furthermore the patches are alternately sidewise displaced such that they form a herringbone pattern. In other words such a next patch of one column is placed on the symmetry lines through nearby patches of the other column. In this way the coupling between the patches is minimized and a high isolation is achieved between the two states of polarization. The achieved two linear states of polarization are utilized separately for polarization diversity. Furthermore the structure of the antenna is designed to compensate for pointing errors between the separate columns due to unsymmetrical ground-planes.

The method according to the present invention is set forth by the attached independent claim 1 and the dependent claims 2 to 4.

Similarly an antenna arrangement according to the present invention is set forth by the attached independent claim 5 and further embodiments are defined in the dependent claims 6 to 8.

BRIEF DESCRIPTION OF THE DRAWINGS

The invention will be further described by reference to the attached drawings wherein same reference numbers refer to same or corresponding elements, and in which.

DETAILED DESCRIPTION

Figure 1:
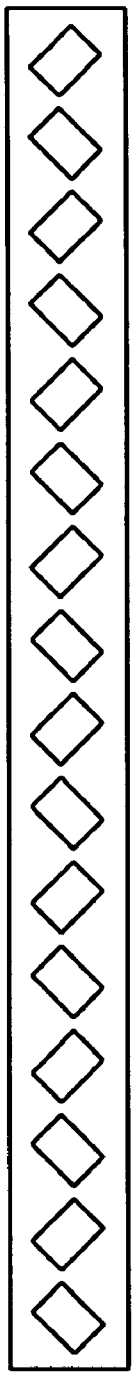
FIG. 1 demonstrates an antenna polarized at ±45° polarized and built up by single polarized elements in the same column according to the state of the art.
Figure 2:
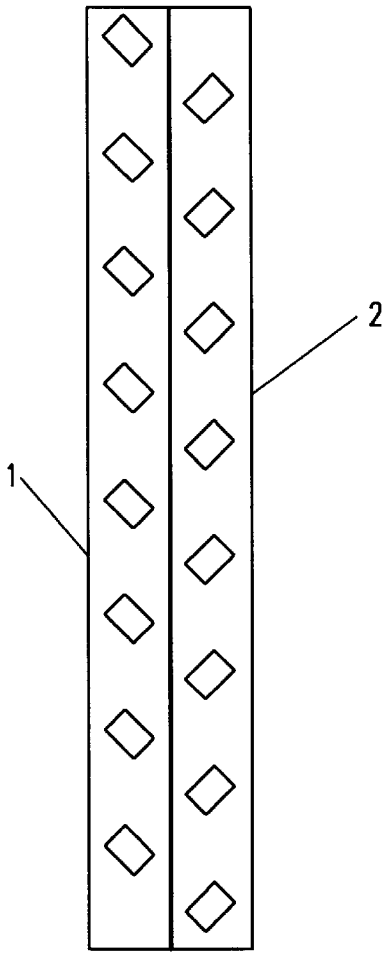
FIG. 2 illustrates an antenna built up by single polarized elements in a respective column to form an antenna polarized at ±45° in accordance with the present invention.
Figure 3:
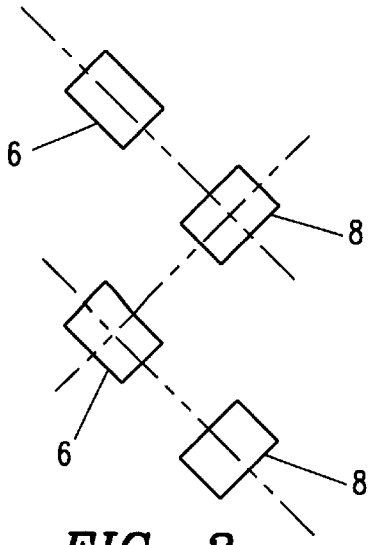
FIG. 3 shows in a more detailed view four patches forming a portion of the herringbone pattern illustrated in FIG. 2.

A method according to the present invention for achieving a better isolation for antennas linearly polarized for instance of the order ±45° is illustrated in FIGS. 2 and 3. The antenna is built up with two separate single polarized antenna columns, a first column 1 presenting a linear polarization of about −45° and a second column 2 linearly polarized at about +45°. Column 1 then will contain a number of patch radiators 6 having their polarization plane at about −45 degrees, while column 2 in the illustrative embodiment will contain a corresponding number of patch radiators 8 having their polarization plane at about +45 degrees. The columns are arranged close alongside each other as demonstrated in FIG. 2. In this way a combined dual polarized antenna is obtained. FIG. 3 illustrates how the symmetry lines of the patches 6 and 8, respectively, should cross each other in accordance with the present method to obtain a maximum isolation. This results in an easily visible herringbone pattern characterizing an antenna array according to the present method.

Figure 4:
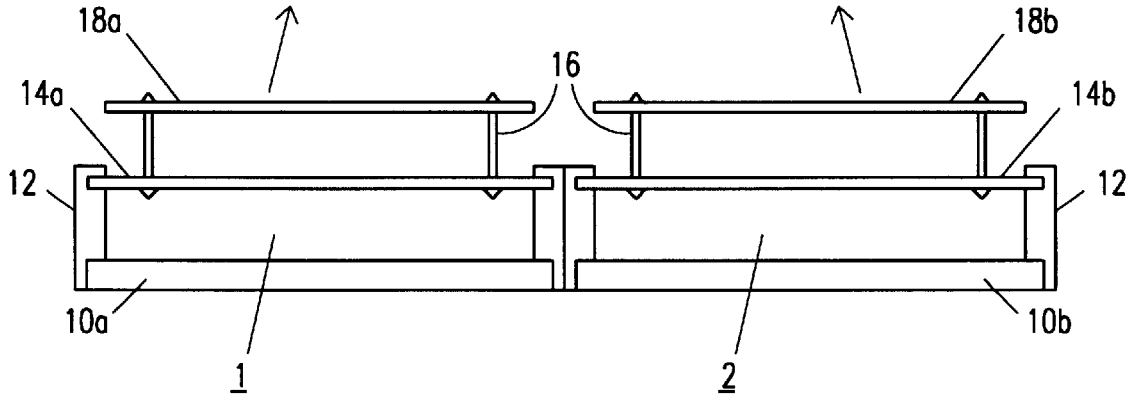
FIG. 4 illustrates a general antenna device designed in accordance with the present invention.

In FIG. 4 is shown a horizontal cross section of a vertically aligned basic antenna array according to FIG. 2. The antenna array consists of the two antenna columns 1 and 2 each presenting a standard back-plane structure. The back-plane structure consists of a back-plane 10*a* carrying studs or a support profile 12 holding a laminate 14*a* presenting slots and distribution network (not shown). In a preferred illustrative embodiment the support profile 12 is made of extruded aluminum, but may as well be made of another non-conducting material. For instance in an illustrative embodiment, which operates around 1800 MHz, the width of the support profile is of the order 250 mm. The laminate 14*a* in turn presents a second set of studs 16 carrying a patch laminate 18*a* at a suitable distance from the slots formed in the laminate 14*a*. The patch laminate 16*a* presents patches 6 demonstrating one direction of linear polarization, while a corresponding patch laminate 18*b* in the column 2 has patches 8, which represent the other polarization.

However, there is one disadvantage with this arrangement in that the ground-plane for vertical column 1 will become unsymmetrical due to the ground-plane of the nearby column 2, and correspondingly the ground-plane of the column 2 will be similarly be affected by the ground plane of column 1. Due to the unsymmetrical ground-planes each column in FIG. 4 will obtain a pointing error in its radiation pattern as is illustrated by the two arrows in FIG. 4 demonstrating a radiation direction for the respective column. This pointing error may be of the order of up to 10 degrees, which is not a negligible value in this context.

Figure 5:
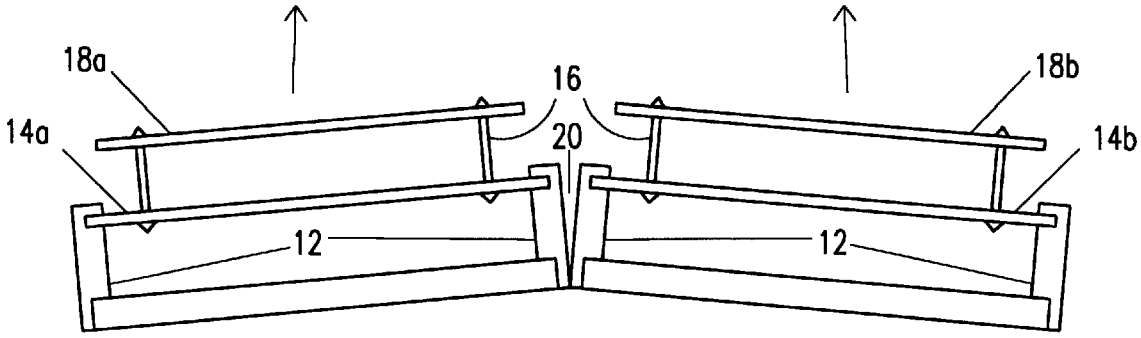
FIG. 5 illustrates a second embodiment of the antenna arrangement according to the present invention for obtaining parallel radiation patterns for the two antenna columns.

FIG. 5 demonstrates a second embodiment of the antenna array according to the present invention in which the radiation direction for each one of the two columns has been corrected. By introducing an angle 20 between the nearby studs or support profiles 12 of the back-plane structures 10*a* and 10*b*, the radiation direction of each column will be compensated, such that the radiation directions for both columns will be in parallel. This is advantageous as the two states of polarization at about ±45° are desired to cover exactly the same area seen from a base station utilizing an antenna array according to the present invention.

Figure 6:
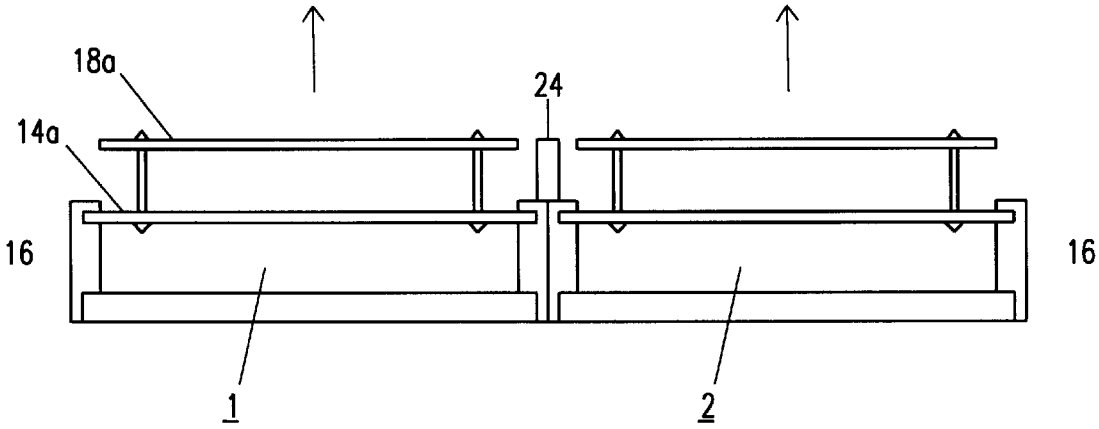
FIG. 6 illustrates a third embodiment of the antenna arrangement according to the present invention for obtaining parallel radiation patterns for the two antenna columns.

FIG. 6 demonstrates a third embodiment of the antenna array according to FIG. 4 wherein a wall 24 between the columns 1 and 2 is introduced for minimizing the effect of the ground-plane to the nearby column. This wall is a conducting part and preferably an integral part of the support profile. By means of the wall 24 the radiation directions of the two columns will now be in parallel as indicated by the arrows.

In the illustrative embodiments reference is made to patch antennas, but it is readily obvious to a person skilled in the art that the principles according to the present description may be used also for other radiation elements, e.g. dipoles or wave-guide slots.

The invention has been described functionally with reference to the drawings related to illustrative embodiments. The more detailed realization can be achieved by a technique, which is well known to persons skilled in the art of microwave antennas. The possibility of an arbitrary combination of different embodiments in order to produce an efficient and appropriate arrangement is also intended to lie within the spirit and scope of the invention.

What is claimed is:

1. A method for obtaining a dual polarized microwave antenna array presenting optimal isolation between linear states of polarization of the order ±45° comprising the steps of:

arranging at least two vertical columns containing a number of radiation elements, arranging a first group of radiation elements in such a vertical column for producing a linear state of polarization at about −45 degrees, arranging a second group of radiation elements in such a vertical column for producing a linear state of polarization at about +45 degrees, aligning a column containing said first group of radiation elements in relation to a column containing said second group of radiation element such that a symmetry line passing through a symmetry center of a radiation element in said first group passes through a symmetry center of an adjacent radiation element in a column containing said second group of radiation elements and a column containing said second group of radiation element in relation to a column containing said first group of radiation elements such that a symmetry line passing through a symmetry center of a radiation element in said second group passes through a symmetry center of an adjacent radiation element in a column containing said first group of radiation elements, to thereby obtain an optimum isolation between said first column and said second columns of radiation elements.

2. The method according to claim 1, comprising the further step of arranging each radiation element in the form of a rectangular patch, whereby the rectangular patches form a herringbone pattern in the antenna arrangement.

3. The method according to claim 1, comprising the further step of arranging each radiation element in the form of a dipole element, whereby the dipole elements form a herringbone pattern in the antenna arrangement.

4. The method according to claim 1, comprising the further step of arranging each radiation element in the form of a wave-guide slot, whereby the rectangular wave-guide slots form a herringbone pattern in the antenna arrangement.

5. The method according to claim 1, wherein the step of aligning further includes aligning a column containing said first group of radiation elements in relation to the column containing said second group of radiation element such that a symmetry line passing through a symmetry center of a radiation element in said first group passes through a symmetry center of each adjacent radiation element in the column containing said second group of radiation elements and the column containing said second group of radiation elements in relation to the column containing said first group of radiation elements such that a symmetry line passing through a symmetry center of a radiation element in said second group passes through a symmetry center of each adjacent radiation element in a column containing said first group of radiation elements.

6. An antenna arrangement for obtaining a dual polarized microwave antenna array presenting optimal isolation between two linear states of polarization of the order ±45° comprising a first antenna column presenting a number of radiation elements linearly polarized at about −45°, a second antenna column presenting a number of radiation elements linearly polarized at about +45°, whereby said first antenna column is vertically aligned with said second antenna column such that a symmetry line along the direction of the polarization plane through a symmetry point of a radiation element in said first antenna column passes through a symmetry center of an adjacent radiation element in said second antenna column and a symmetry line along the direction of the polarization plane through a symmetry point of a radiation element in said second antenna column passes through a symmetry center of an adjacent radiation element in said first antenna column to thereby obtain an optimum isolation between said first and second columns of radiation elements.

7. The arrangement according to claim 6, wherein each antenna column comprises a back-plane structure consisting of a support profile holding a first laminate presenting slots and a distribution network, said first laminate carrying a second set of studs holding a second laminate forming a number of rectangular patches.

8. An antenna arrangement for obtaining a dual polarized microwave antenna array presenting optimal isolation between two linear states of polarization of the order ±45° comprising a first antenna column presenting a number of radiation elements linearly polarized at about −45°, a second antenna column presenting a number of radiation elements linearly polarized at about +45°, whereby said first antenna column is vertically aligned with said second antenna column such that a line along the direction of the polarization plane through a symmetry point of a radiation element in said first antenna column passes through a symmetry center of an adjacent radiation element in said second antenna column and a line along the direction of the polarization plane through a symmetry point of a radiation element in said second antenna column passes through a symmetry center of an adjacent radiation element in said first antenna column to thereby obtain an optimum isolation between said first and second columns;

wherein each antenna column comprises a back-plane structure consisting of a support profile holding a first laminate presenting slots and a distribution network said first laminate carrying a second set of studs holding a second laminate forming a number of rectangular patches; and wherein said first column and said second column are mounted with an angle between a first and a second support profile for compensating a pointing error between said first antenna column and said second antenna column due to unsymmetrical ground planes.

9. An antenna arrangement for obtaining a dual polarized microwave antenna array presenting optimal isolation between two linear states of polarization of the order ±45° comprising a first antenna column presenting a number of radiation elements linearly polarized at about −45°, a second antenna column presenting a number of radiation elements linearly polarized at about +45°, whereby said first antenna column is vertically aligned with said second antenna column such that a line along the direction of the polarization plane through a symmetry point of a radiation element in said first antenna column passes through a symmetry center of an adjacent radiation element in said second antenna column and a line along the direction of the polarization plane through a symmetry point of a radiation element in said second antenna column passes through a symmetry center of an adjacent radiation element in said first antenna column to thereby obtain an optimum isolation between said first and second columns;

wherein each antenna column comprises a back-plane structure consisting of a support profile holding a first laminate presenting slots and a distribution network, said first laminate carrying a second set of studs holding a second laminate forming a number of rectangular patches; and wherein a separation wall is vertically inserted between said second laminates of said first antenna column and said second antenna column for minimizing interaction between the ground planes of said first antenna column and said second antenna column.

* * * * *